United States Patent [19]

Anzinger

[11] 4,422,271

[45] Dec. 27, 1983

[54] DOUBLE-WALLED MASONRY

[76] Inventor: Hedwig Anzinger, Birkenstrasse 11, A-4600 Wels, Austria

[21] Appl. No.: 256,789

[22] Filed: Apr. 23, 1981

[30] Foreign Application Priority Data

Apr. 25, 1980 [AT] Austria ..... 2228/80

[51] Int. Cl.[3] ..... E04B 1/74; E04B 1/70

[52] U.S. Cl. ..... 52/302; 52/404; 52/407

[58] Field of Search ..... 52/302, 303, 408, 410, 52/503, 505, 404, 405, 268, 250, 378, 379, 407

[56] References Cited

U.S. PATENT DOCUMENTS

| | | | |
|---|---|---|---|
| 616,652 | 12/1898 | Booraem | 52/302 |
| 732,102 | 6/1903 | Moulton et al. | 52/503 |
| 793,645 | 7/1905 | Ewing | 52/503 |
| 2,213,355 | 9/1940 | Woodworth | 52/303 |
| 2,634,601 | 4/1953 | Tillery | 52/303 |
| 3,619,961 | 11/1971 | Sterrett et al. | 52/302 |
| 4,328,652 | 5/1982 | Naumovich, Jr. | 52/410 |

FOREIGN PATENT DOCUMENTS

| | | | |
|---|---|---|---|
| 2417138 | 10/1975 | Fed. Rep. of Germany . | |
| 614700 | 12/1926 | France | 52/303 |
| 7336354 | 5/1975 | France . | |

*Primary Examiner*—John E. Murtagh
*Assistant Examiner*—Michael Safavi
*Attorney, Agent, or Firm*—Kurt Kelman

[57] ABSTRACT

A double walled masonry with an interior insulating layer of mineral wool or the like and a free space between the insulating layer and outer wall for airing the masonry.

3 Claims, 2 Drawing Figures

DOUBLE-WALLED MASONRY

Figure 1:
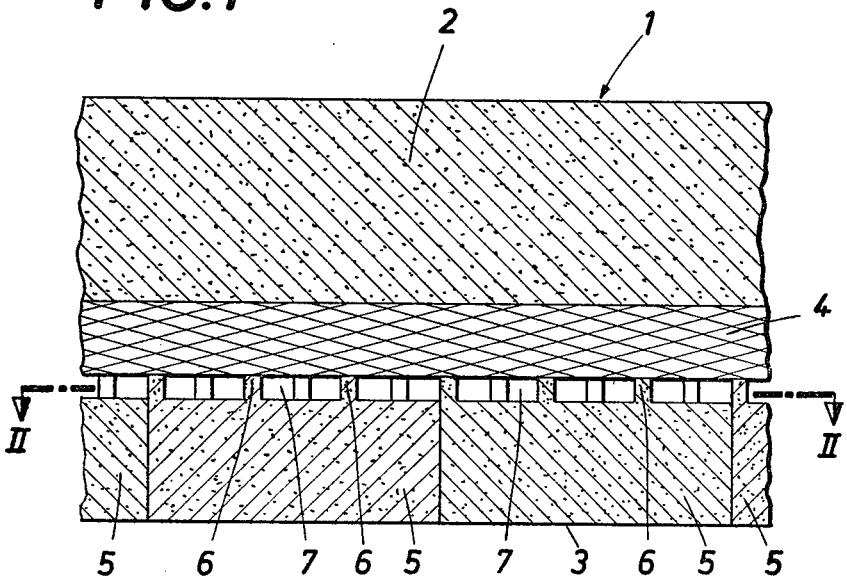

The invention relates to a double-walled masonry with an interior insulating layer of mineral wool or the like and a free space between the insulating layer and outer wall for airing the masonry.

Double-walled masonry with a central insulating layer is distinguished by its good heat storage capacity and particularly by its excellent insulating properties, mineral wool or vapor-permeable polystyrene or other insulating materials having a smaller vapor diffusion resistance factor than the supporting masonry portion, that is the inner wall, being especially useful as insulating material because these materials permit breathing of the masonry. However, since the insulating effect of mineral wool or the like substantially deteriorates as the humidity increases, it is necessary to provide for a sufficient airing of the masonry so that neither water vapor seeping through the inner wall nor heavy rain penetrating through the outer wall wet the insulating layer in excess of a permissible degree. For this reason, a free space is provided between the insulating layer and the outer wall, which space communicates with the atmosphere in a bottom region and is open at the top, thereby permitting an airing and a corresponding removal of humidity. However, it has been required heretofore to obtain such a free space by limiting the thickness of the insulating layer to the desired gage by means of special holding devices, such as a lattice frame, a rail structure or a multiplicity of special large-headed spacing nails or the like, causing an enormous expenditure of labor and material, and leading immediately to very unpleasant and irreparable consequences if the insulating layer is mounted somewhat carelessly.

It is the object of the invention to eliminate these disadvantages and to provide masonry of the first described type which may be constructed in a simple, rational manner and wherein the desired airing is always assured.

The invention accomplishes this object with an outer wall comprised of building blocks having inwardly projecting, perpendicularly extending ribs whose average width is less than the average width of the slots defined therebetween and forming the free space. These ribs always keep the insulating layer automatically at a corresponding distance so that the formation of the free space required for airing is assured merely by the conventional erection of the masonry without requiring an additional lattice framework or the like. Due to the width relationship between the ribs and the slots therebetween, through air passages extending from the bottom to the top are formed when the outer wall is erected, independent of the type and magnitude of the staggering of the superimposed rows of building blocks, the air passages operating like flues and bringing about the desired airing. The ribs may be integral with the building block or may be formed by webs connected to the building block by bonding, foaming or the like and, furthermore, the ribs need not extend continuously along the entire height of the block, their presence in discontinous sections being sufficient. Their cross-sectional shape also may be varied, and all kinds of building elements, such as individual bricks or prefabricated wall parts may serve as building blocks.

To avoid the condensation of the humidity diffused into the insulating layer by the undercooling of the outer wall from time to time, the contact surface between the ribs and the insulating layer must be held as small as possible. The ribs must, however, be sufficiently high so as to prevent a closing of the slots by the soft insulating material, the height of the ribs being commensurate with the width of the slots, so that there is a certain correlation between form and magnitude of the ribs and their spacing in view of the prevalent rigidity properties. Favorable conditions prevail if the average width of the ribs is about half the maximum height of the ribs and the average width of the slots is about two to five times the maximum height of the ribs. The average width and the maximum height of the ribs should be at least 1 and 2 cm, respectively, and the average width of the slots should be 5 cm. These measurements are, of course, only approximate guiding values which are strongly influenced by the material of the building block and of the insulating layer as well as the cross-sectional shape of the ribs. The rectilinearly extending ribs are not limited to any specific embodiment and they may have any cross section, for example, rectangular, trapezoidal or round, the measurements constituting average values. In the end, the only thing that matters is that the slots remaining between the ribs are large enough to produce a flue effect, and that the ribs prevent penetration of the insulating layer into the free space defined by the slots, with the smallest possible contact surface with the insulating layer.

Figure 2:
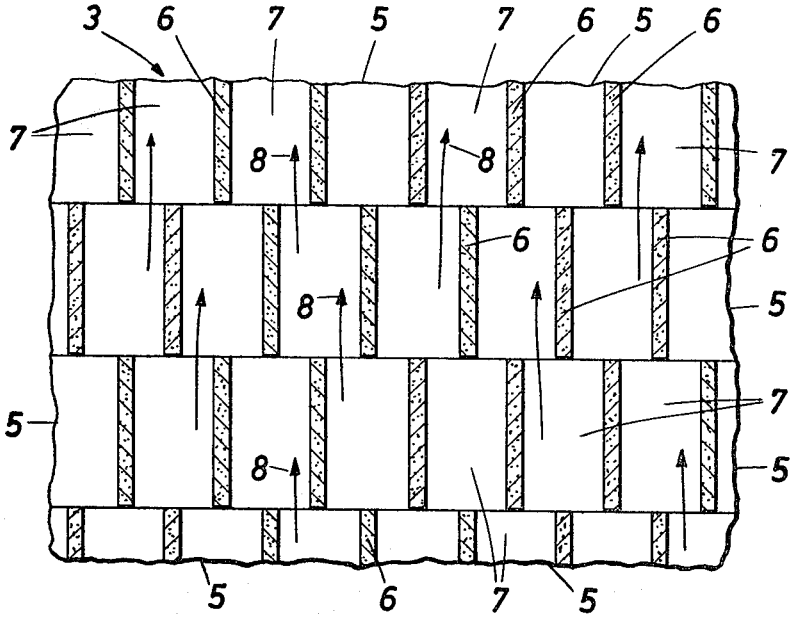

The subject matter of the invention is purely schematically illustrated in an embodiment shown in the drawing, wherein FIGS. 1 and 2 show masonry according to the invention in horizontal section and in a vertical section along line II—II of FIG. 1.

Double-walled masonry 1 is comprised of supporting inner wall 2, outer wall 3 erected at a distance therefrom and a central insulating layer 4 of mineral wool or the like. To avoid wetting of insulating layer 4, which would result in a considerable reduction of the insulating properties and a substantial deterioration of the ambient climate, masonry 1 must be aired. This requires a free space between outer wall 3 and insulating layer 4 for conducting the air. To enable this free space to be created in a simple manner simultaneously with the conventional erection of the masonry, outer wall 3 is constructed of building blocks 5 with inwardly projecting, perpendicularly extending ribs 6 which are narrower than slots 7 defined between two adjacent ribs 6. Slots 7 of the individual building blocks 5 define through channels extending from the bottom to the top of finished outer wall 3, through which air flows (arrows 8) and which bring about the desired airing of masonry 1. At the same time, ribs 6 of building blocks 5 hold insulating layer 4 at a distance and prevent the relatively soft insulating material of the insulating layer from penetrating into slots 7. As indicated in FIG. 2, the individual building blocks 5 of outer wall 3 may be staggered in relation to each other in the conventional construction mode without interfering with the channel formation for air flow 8 since no rib of one block can close off any slot of an adjacent block.

I claim:

1. Double-walled masonry comprising (a) an inner supporting wall, (b) an outer wall defining a free space with the inner wall, the outer wall being comprised of (1) individual building blocks having perpendicularly extending ribs projecting into the free space and defining slots therebetween to constitute the free space, the ribs having an average width which is smaller than the average width of the slots, and (c) an interior insulating layer between the inner supporting wall and the ribs, the ribs projecting to the insulating layer for holding the same in place and the slots permitting airing of the double-walled masonry.

2. Double-walled masonry according to claim 1, wherein the insulating layer is of mineral wool.

3. Double-walled masonry according to claim 1 or 2, wherein the average width of the ribs is about half the maximum height thereof and the average width of the slots is about 2 to 5 times the maximum height of the ribs.

* * * * *